US008126381B2

(12) United States Patent
Pang

(10) Patent No.: US 8,126,381 B2
(45) Date of Patent: Feb. 28, 2012

(54) TRANSFER APPARATUS AND IMAGE FORMING DEVICE HAVING THE SAME

(75) Inventor: Jeong-hun Pang, Yongin-si (KR)

(73) Assignee: SAMSUNG Electronics Co., Ltd., Suwon-si (KR)

( * ) Notice: Subject to any disclaimer, the term of this patent is extended or adjusted under 35 U.S.C. 154(b) by 1112 days.

(21) Appl. No.: 11/954,139

(22) Filed: Dec. 11, 2007

(65) Prior Publication Data

US 2008/0181682 A1 Jul. 31, 2008

(30) Foreign Application Priority Data

Jan. 26, 2007 (KR) ..... 10-2007-0008463

(51) Int. Cl.
*G03G 15/01* (2006.01)
*G03G 15/20* (2006.01)

(52) U.S. Cl. ..... 399/302; 399/308

(58) Field of Classification Search ..... 399/302, 399/308

See application file for complete search history.

(56) References Cited

U.S. PATENT DOCUMENTS 5,991,575 A 11/1999 Okiyama et al.

FOREIGN PATENT DOCUMENTS

| | | |
|---|---|---|
| JP | 04-317936 | 11/1992 |
| JP | 05-319611 | 12/1993 |
| JP | 2001-122418 | 5/2001 |

OTHER PUBLICATIONS

European Search Report dated May 8, 2008 issued in EP 07123258.1.

*Primary Examiner* — David Gray
*Assistant Examiner* — Erika J Villaluna
(74) *Attorney, Agent, or Firm* — Stanzione & Kim, LLP

(57) ABSTRACT

A transfer apparatus compensates for a floating movement of the a transfer belt, and an image forming device includes the transfer apparatus. The image forming device includes an image forming device body having an image forming unit, and a transfer apparatus to transfer an image formed by the image forming unit onto a printing medium. The transfer apparatus includes a transfer belt, a driving unit to rotate the transfer belt, and at least one regulating unit to regulate a floating movement of the transfer belt and the driving unit thus to be in position.

23 Claims, 5 Drawing Sheets

TRANSFER APPARATUS AND IMAGE FORMING DEVICE HAVING THE SAME

CROSS-REFERENCE TO RELATED APPLICATIONS

This application claims the benefit under 35 U.S.C. §119 (a) from Korean Patent Application No. 10-2007-8463, filed on Jan. 26, 2007, in the Korean Intellectual Property Office, the entire content of which is incorporated herein by reference

BACKGROUND OF THE INVENTION

1. Field of the Invention

The present general inventive concept relates to a transfer apparatus and an image forming device having the same.

2. Description of the Related Art

In general, an image forming apparatus, such as a copier, a printer, a facsimile, and a multi function machine embodying functions of the copier, printer, and facsimile as a single device, has a function, which prints an image on a printing medium. Such an image forming apparatus includes a feeding unit to feed the printing medium, a developing unit to develop an image on an photoconductive medium, a transfer apparatus to transfer the developed image onto the printing medium, a fixing unit to fix the transferred image, and a discharging unit to discharge the printing medium to the outside. Among these units, an example of the transfer unit is illustrated in FIG. 1.

Referring to FIG. 1, a transfer apparatus of a general image forming device includes a transfer belt 10, which is supported and rotated by a pair of rollers 21 and 22. The transfer belt 10 receives an image from a photoconductive medium and transfers the received image onto a printing medium while being rotated. At this time, one of the pair of rollers 21 and 22 is a driving roller 21, which receives a driving force from a driving source, and the other is an idle roller 22. The idle roller 22 at both ends is supported by an elastic member 30 to apply a tension to the transfer belt 10.

However, the transfer belt 10 generates a shaking or floating movement in an axial direction of the idle roller 22 in rotation. Such a floating movement of the transfer belt 10 in rotation causes a transfer quality to deteriorate.

To address such a problem, a method, which forms the idle roller 22 in the form of a crown in which a center and both ends thereof have deferent diameters, or forms a guide projection and a guide groove on an inner side surface of the transfer belt 10 and in a portion of the idle roller 22 corresponding to the guide projection, respectively, was proposed. However, as shapes of the idle roller 22 and/or the transfer belt 10 are changed, a problem occurs, in that fabrication costs are increased and a friction at specific portions is increased to cause the specific portions to wear.

Also, a conventional method has been used for additionally installing a separate sensing means and a separate compensating means capable of sensing the movement of the transfer belt 10 and compensating for it. However, fabrication costs for additionally installing the separate sensing means and a separate compensating means are increased.

SUMMARY OF THE INVENTION

The present general inventive concept provides a transfer apparatus capable of compensating for a floating movement of a transfer belt, and an image forming device having the same.

The present general inventive concept also provides a transfer apparatus having a mechanism compensate for a floating movement of a transfer belt, with a low cost and a simple structure, and an image forming device having the same.

Additional aspects and utilities of the present general inventive concept will be set forth in part in the description which follows and, in part, will be obvious from the description, or may be learned by practice of the general inventive concept The foregoing and/or other aspects and utilities of the present general inventive concept may be achieved by providing an image forming device, including an image forming device body having an image forming unit, and a transfer apparatus to transfer an image formed by the image forming unit onto a printing medium. The transfer apparatus includes a transfer belt, a driving unit to rotate the transfer belt, and at least one regulating unit to regulate a floating movement of the transfer belt and the driving unit thus to be in position.

The driving unit may include a plurality of rollers to come in contact with and to rotatably support an inner side surface of the transfer belt.

The regulating unit may include a regulating member to interfere with an axial movement of one of the plurality of rollers, and an elastic member disposed between an axis of the one roller and the regulating member to apply an elastic force in a driving direction of the transfer belt.

The plurality of rollers may include at least one driving roller to rotatably support one end of the transfer belt and at least one idle roller to rotatably support the other end of the transfer belt.

The regulating unit may regulate a floating movement of the idle roller.

The regulating member may be disposed to be rotatable between a first position coming in contact with an axis of the idle roller positioned in position and a second position rotated by an axial movement of the idle roller.

The regulating member may include a contacting end to come in contact with the axis of the idle roller and a supporting end to move in combination with a movement of the contacting end and to support the elastic member.

The contacting end and the supporting end may be in right angles to each other about a rotating axis.

The elastic member may press a shaft of the idle roller by a rotating range of the regulating member in the rotating direction of the transfer belt.

The foregoing and/or other aspects and utilities of the present general inventive concept may be achieved by providing a transfer apparatus, including a transfer belt, a driving unit to rotate the transfer belt, and at least one regulating unit to regulate a floating movement of the transfer belt and the driving unit to maintain a position thereof.

The foregoing and/or other aspects and utilities of the present general inventive concept may also be achieved by providing a transfer apparatus usable with an image forming apparatus, including a transfer belt, a driving unit to rotate the transfer belt, and at least one regulating unit having a regulating member disposed to be movable according to a movement of the driving unit and an elastic member connected between the driving unit and the regulating member to regulate a movement of one of the transfer belt and the driving unit.

The movement may include a first movement in a first direction and a second movement in a second direction, and a combination of the regulating member and the elastic member may regulate the first movement and the second movement.

The elastic member may control the regulating member to be biased toward the driving unit.

The regulating member may include one end connected to the elastic member and another end extended from the one end toward the driving unit to move according to the second movement.

The elastic member may generate a first elastic force to the regulating member with respect to the driving unit, and a second elastic force to the driving unit to regulate the second movement.

The regulating member may be rotatably disposed to move according to the second movement of the one of the transfer belt and the driving unit; and the elastic member may be elastically connected between the driving unit and the regulating member to control at least one of the first movement and the second movement.

The at least one regulating unit may include first and second regulating units disposed opposite sides of the driving unit, the regulating member may include first and second regulating members, and the elastic member may include first and second elastic members to form the first and second regulating units with the first and second elastic members, respectively.

The first regulating member may move in a first direction according to the movement, the second regulating member may move in a second direction according to the movement; and the second elastic member may generate an elastic force to the one of the driving unit and the transfer belt in a third direction to regulate the movement.

The transfer apparatus may further include an interfering member to restrict the movement of the second regulating member.

BRIEF DESCRIPTION OF THE DRAWINGS

These and/or other aspects of the present general inventive concept will become apparent and more readily appreciated from the following description of the exemplary embodiment, taken in conjunction with the accompanying drawings of which

Throughout the drawings, the same drawing reference numerals will be understood to refer to the same elements, features, and structures.

DETAILED DESCRIPTION OF THE PREFERRED EMBODIMENTS

Figure 1:
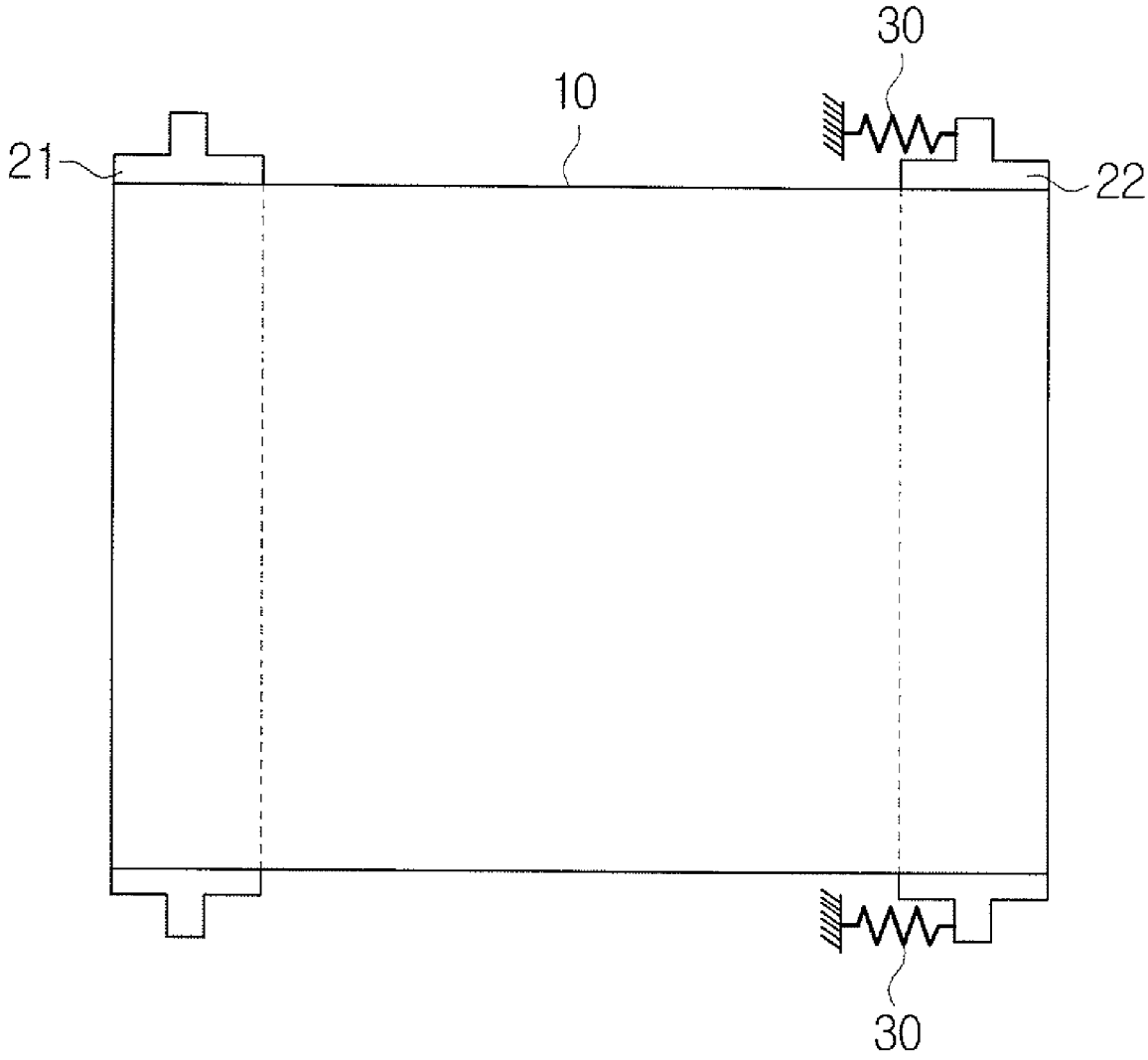
FIG. 1 (PRIOR ART)
FIG. 1 is a top plan view schematically illustrating a conventional transfer apparatus of a general image forming device.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

Figure 2:
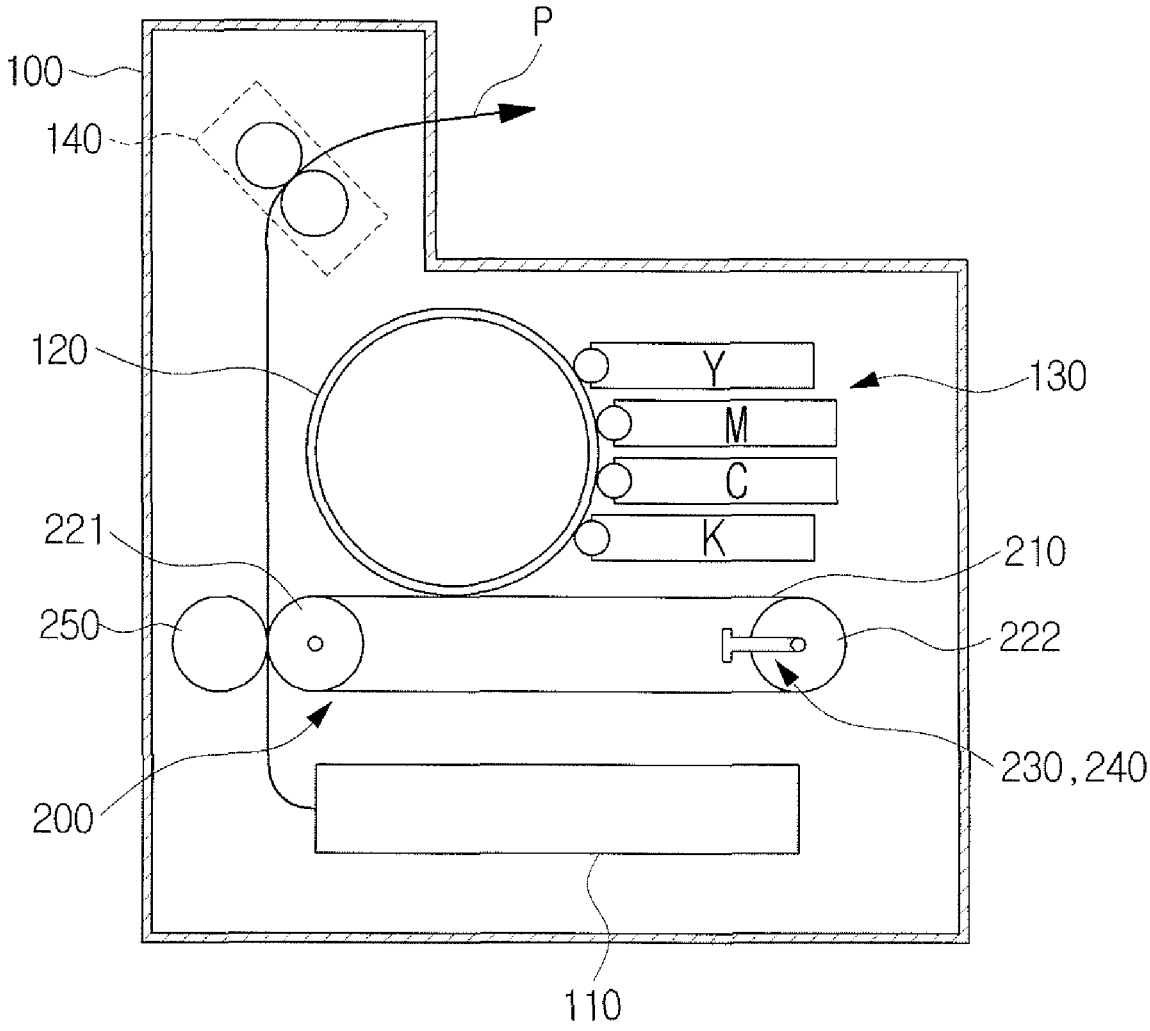
FIG. 2 is a schematic view illustrating a construction of an image forming device having a transfer apparatus according to an exemplary embodiment of the present general inventive concept.

Referring to FIG. 2, an image forming device according to the exemplary embodiment of the present general inventive concept has a feeding unit 110 to feed a printing medium P, a photoconductive medium 120 on which an electrostatic latent image is formed, a developing unit 130 to develop the electrostatic latent image with a developer, a transfer apparatus 200 to transfer the developed image onto the printing medium P, and a fixing unit 140 to fix the image transferred on the printing medium P, which are disposed in an image forming device body 100. Here, the photoconductive medium 120 and the developing unit 130 form an image forming unit.

Since technical constructions and operations of the image forming unit and the feeding unit 110 constructed as described above are well-known in the art, detailed description and illustration thereof will be omitted.

Figure 3:
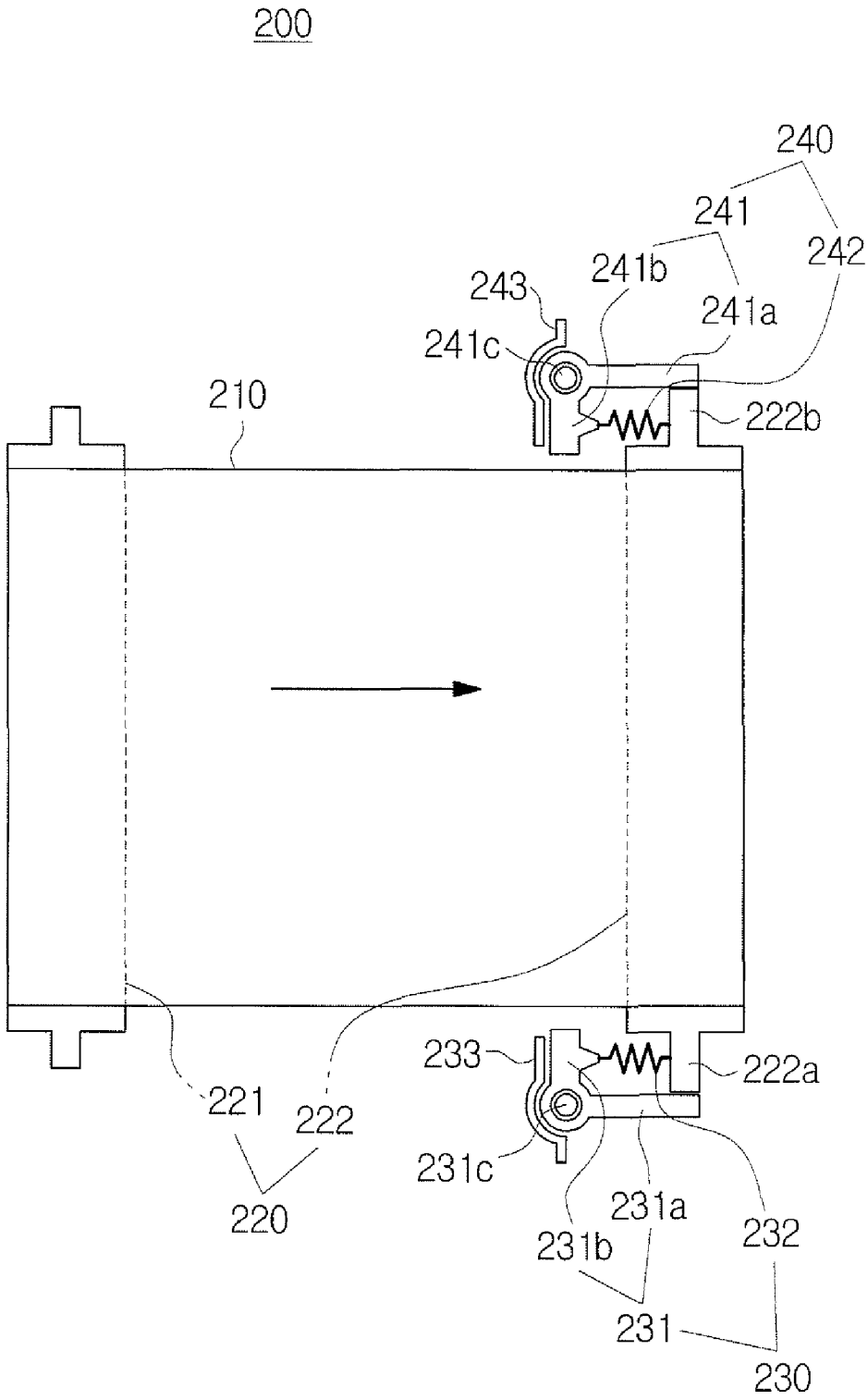
FIG. 3 is a top plan view schematically illustrating the transfer apparatus of FIG. 2.

Referring to FIG. 3, the transfer apparatus 200 of the image forming device, which transfers the image developed on the photoconductive medium 120 onto the printing medium P, includes a transfer belt 210, a driving unit 220, and a regulating unit. The regulating may have first and second regulating units 230 and 240, for example.

The transfer belt 210 receives one or more images, which are developed on the photoconductive medium 120 by the developing unit 130. The one or more developed images overlap each other to form a full image. The images transferred onto the transfer belt 210 are transferred onto the printing medium P as the full image by a backup roller 250, which rotates while facing the transfer belt 210 to interpose the printing medium P therebetween. Since technical constructions and operations on such an image transfer by the transfer belt 210 are well-known in the art, detailed description and illustration thereof will be omitted.

The driving unit 220 includes a plurality of rollers 221 and 222, which comes in contact with and rotatably supports an inner side surface of the transfer belt 210 to drive or rotate the transfer belt 210.

In the present embodiment, the plurality of rollers 221 and 222 is illustrated as a driving roller 221 and an idle roller 222. The driving roller 221 rotatably supports one end of the transfer belt 210 and receives a driving force from a driving source (not illustrated). The idle roller 222 rotatably supports the other end of the transfer belt 210. Here, the driving roller 221 rotates while facing the backup roller 250 to interpose the transfer belt 210 therebetween.

Each of the driving roller 221 and the idle roller 222 can be provided in plural to rotate the transfer belt 210. It is possible that one of the driving roller 221 and the idle roller 222 is provided in plural to rotate the transfer belt 210

The regulating units 230 and 240 regulate a floating movement of the transfer belt 210 and the driving unit 220. Here, since the regulating units 230 and 240 are correspondingly disposed to one shaft 222*a* and the other shaft 222*b* projecting from both ends of the idle roller 222 to regulate a floating movement of the idle roller 222 of the driving unit 220. The first and second regulating units 230 and 240 include first and second regulating members 231 and 241 and first and second elastic members 232 and 242, respectively.

The floating movement may include a shaking movement of at least one of the driving roller 221 and the idle roller 222 and/or the transfer unit 210, and/or a movement generating during moving or rotating the transfer belt 210 in a rotational direction and an axial direction of the at least one of the driving roller 221 and the idle roller 222.

The first and second regulating members 231 and 241 interfere with an axial movement of the idle roller 222. To be specific, the first and second regulating members 231 and 241 come in contact with the one shaft 222*a* and the other shaft 222*b* of the idle roller 222 and rotate about first and second rotating shafts 231*c* and 241*c* by the axial movement of the idle roller 222, respectively.

When the first and second rotating shafts 231*c* and 241*c* may be formed on the first and second regulating members 231 and 241, respectively, the first and second rotating shafts 231*c* and 241*c* are rotatably supported by the main body 100. When the first and second regulating members 231 and 241 are disposed to rotate with respect to the first and second rotating shafts 231*c* and 241*c*, respectively, the first and second rotating shafts 231*c* and 241*c* are fixedly supported by the main body 100 or mounted on the main body 100.

The one shaft 222*a* and the other shaft 222*b* may be formed on the opposite ends of the idle roller 222, may rotate together with the idle roller 222, and may have rotation axes parallel to a rotational axis of the idle roller.

It is possible that the rotation axes of the one shaft 222*a* and the other shaft 222*b* may be disposed on the rotational axis of the driving roller 221 or another idle roller, and the first and second regulating units 230 and 240 are disposed to correspond to the one shaft 222*a* and the other shaft 222*b* thereof.

Figure 4A:
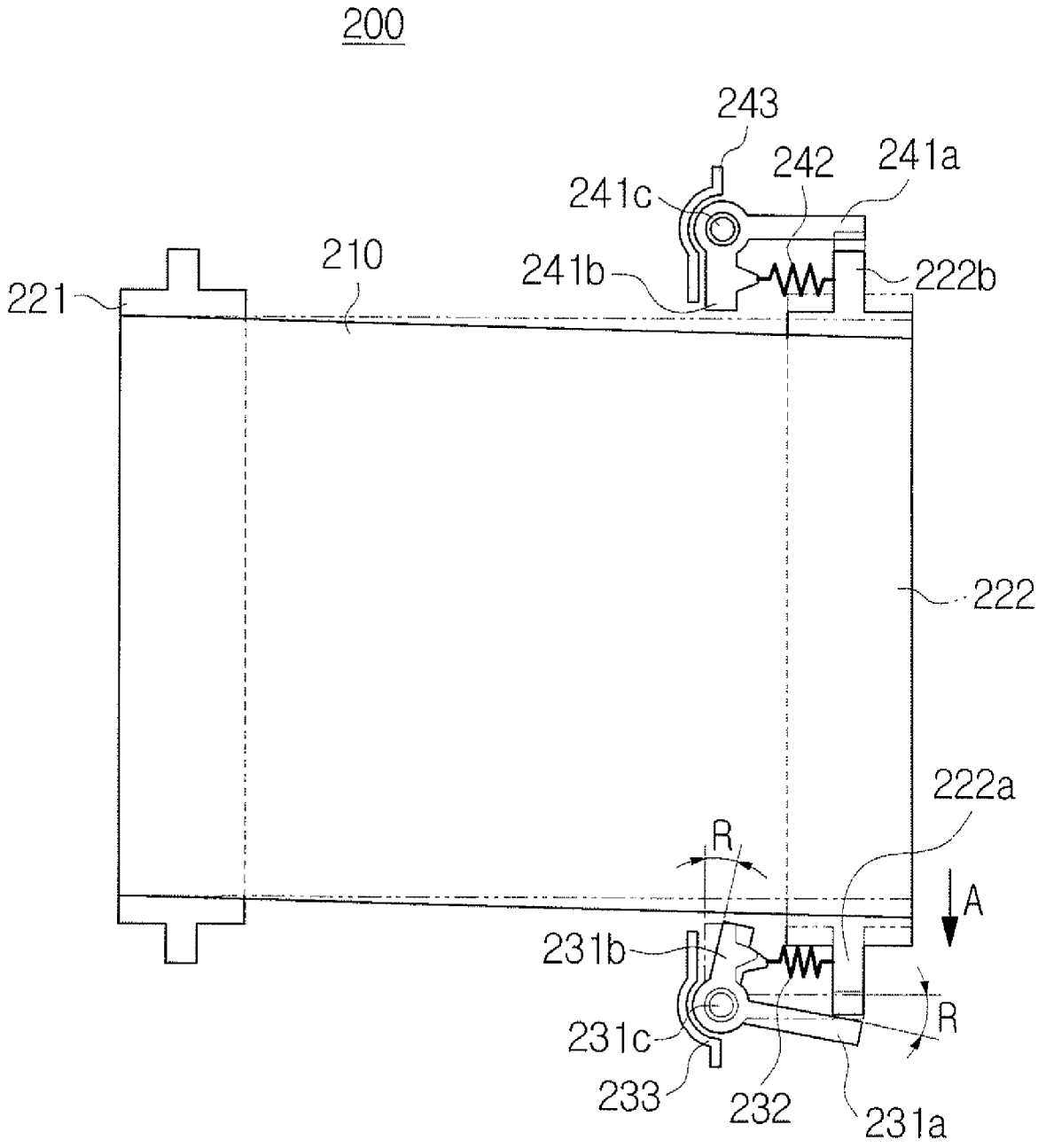
FIGS. 4A and 4B are top plan views illustrating an operation of regulating a floating movement of a transfer belt illustrated in FIG. 3.

As illustrated in FIGS. 3 and 4A, the first and the second regulating members 231 and 241 are rotatable between a first position where the first and the second regulating members 231 and 241 come in contact with corresponding ones of the one shaft 222*a* and the other shaft 222*b* of the idle roller 222 which are positioned in a normal position and a second position where the first and the second regulating members 231 and 241 are moved or rotated by the axial movement of the idle roller 222 which is positioned in an abnormal position, respectively.

Also, the first and the second regulating members 231 and 241 include first and second contacting ends 231*a* and 241*a* and first and second supporting ends 231*b* and 241*b*, respectively. The first and second contacting ends 231*a* and 241*a* come in contact with corresponding ones of the one shaft 222*a* and the other shaft 222*b* of the idle roller 222, respectively. The first and second supporting ends 231*b* and 241*b* move according to a movement of the first and the second contacting end 231*a* and 241*a* and support first and second elastic members 232 and 242, respectively. Here, the first and second contacting ends 231*a* and 241*a* and the first and second supporting ends 231*b* and 241*b* are in right angles with respect to each other about the first and the second rotating shafts 231*c* and 241*c*, respectively.

The first and second elastic members 232 and 242 are disposed between the one axis 222*a* and the other axis 222*b* of the idle roller 222 and corresponding ones of the first and second supporting ends 231*b* and 241*b* the first and second regulating members 231 and 241 to apply elastic forces in a rotating direction of the transfer belt 210 or in a direction to move the idle roller 222 away from the driving roller 221. The transfer belt 210 is rotated in a direction of arrow illustrated in FIG. 3.

That is, the first elastic member 232 is disposed between the first supporting end 231*b* and the one shaft 222*a* of the idle roller 222, and the second elastic member 242 is disposed between the second supporting end 241*b* and the other shaft 222*b* of the idle roller 222. The elastic forces of the first and the second members 232 and 242 cause the transfer belt 210 to be tensioned between the driving roller 221 and the idle roller 222.

Figure 4B:
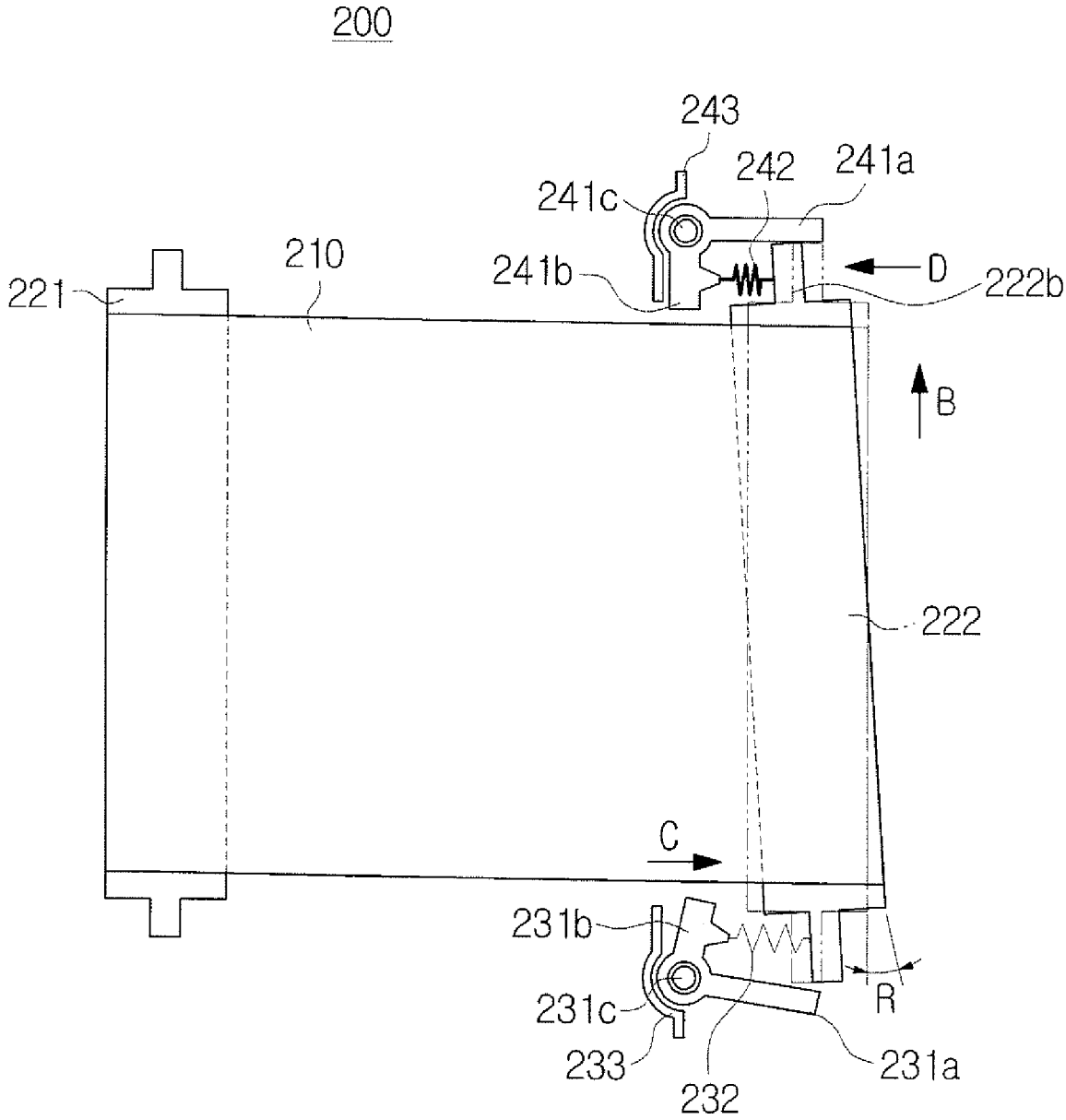

As illustrated in FIGS. 4A and 4B, the first and second elastic members 232 and 242 presses the one shaft 222*a* and the other shaft 222*b* of the idle roller 222 by a rotating range R of the first and second regulating members 231 and 241 in the rotating direction of the transfer belt 210, respectively.

To be more specific, if the contacting end 231*a* of the first regulating member 231 is rotated to the second position by the rotating range R while coming in contact with the one shaft 222*a* of the idle roller 222 moved in a direction of arrow A, as illustrated in FIG. 4A, the first supporting end 231*b* extended in a right angle about first rotating axis 231*c* from the first contacting end 231*a* is also rotated by the rotating range R. Then, the first elastic member 232 supported on the first supporting end 231*b* moves the one shaft 222*a* of the idle roller 222 in a direction of arrow C with its elastic force.

Here, in combination with the movement of the one shaft 222*a* of the idle roller 222 by the first elastic member 232, the other shaft 222*b* of the idle roller 222 moves in a direction of arrow D opposite to the direction of arrow C.

To interfere with a moving range of the first and second regulating members 231 and 241 in the direction of arrow D as illustrated in FIG. 4B, first and second interfering member 233 and 243 are installed. To be more specific, the first and second interfering members 233 and 243 interfere with movements of the first and the second supporting ends 231*b* and 241*b* in the direction of arrow D, so that even though the one shaft 222*a* or the other shaft 222*b* of the idle roller 222 is floatingly moved in the direction of arrow D, the first and the second regulating members 231 and 241 are not rotated, but maintained in the first position.

That is, the first and the second regulating members 231 and 241 are returned from the second position to the first position, and the idle roller 222 is returned to its original position with respect to the driving roller 221, thereby controlling the transfer belt 210 to be in a desired position to transfer the formed image from the photosensitive medium 120 to the printing medium P.

Hereinafter, a regulating operation of the transfer apparatus of the image forming device constructed as described above will be explained with reference to FIGS. 3 through 4B.

As illustrated in FIG. 3, the transfer belt 210 is rotated in a direction of illustrated arrow with at both ends supported by the driving roller 221 and the idle roller 222. At this time, as illustrated in FIG. 4A, if the transfer belt 210 is moved in a direction of arrow A while rotating without a separate fixing unit, the idle roller 222 is also moved in the direction of arrow A along with the transfer belt 210 by a friction between the idle roller 222 and the inner side surface of the transfer belt 210.

With such a movement of the idle roller 222 in the direction of arrow A, the first contacting end 231*a* of the first regulating member 231, which is in the first position coming in contact with the one shaft 222*a* of the idle roller 222, is rotated by a rotating range R. According to this, the first supporting end 231*b* connected at a right angle about the first rotating axis 231*c* to the first contacting end 231*a* is rotated by the rotating range R, and thus the first regulating member 231 is rotated to the second position. At this time, the first elastic member 232 supported by the first supporting end 231*b* presses the one shaft 222*a* of the idle roller 222 in a direction of arrow C, as illustrated in FIG. 4B.

The other shaft 222*b* of the idle roller 222 is moved in a direction of arrow D by the one shaft 222*a* moved in the direction of arrow C. At this time, since the second supporting end 241*b* is interfered with the second interfering member 243, only the second elastic member 242 is compressed, and the second regulating member 241 is not rotated. As a result, the idle roller 222 is inclined in a given angle, so that the transfer belt 210 is moved in a direction of arrow B toward the other axis 222*b*, which is relatively more inclined.

Due to a restoration of the elastic force of the compressed second elastic member 242 with the movement of the transfer belt 210 in the direction of arrow B, the idle roller 222 is returned to a previous position, i.e., an original position. At this time, the first and second regulating members 231 and 241 are also rotated due to restored elastic forces of the first and second elastic members 232 and 242 and interferences of the one shaft 222*a* and the other shaft 222*b* of the idle roller 222, and thus returned to the first position.

In the present embodiment, the first and second regulating units 230 and 240 have been explained and illustrated as regulating the movements of the idle roller 222 and the transfer belt 210 in the direction of arrow A. However, when the first and second regulating units 230 and 240 regulate the movements of the idle roller 222 and the transfer belt 210 in the direction of arrow B, operations thereof are carried out in the same principle or manner as those described above.

As apparent from the foregoing description, according to the exemplary embodiment of the present general inventive concept, the transfer apparatus and the image forming device having the same regulate the idle roller of the driving unit, which floatingly moves along with the transfer belt by the friction therewith. Accordingly, the transfer apparatus and the image forming device having the same according to the exemplary embodiment of the present invention can regulate the floating movement of the transfer belt and thus position the transfer belt in position with a simple structure, thereby allowing fabrication costs to reduce and allowing a transfer quality to improve.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. An image forming device, comprising:

an image forming device body having an image forming unit; and a transfer apparatus to transfer an image formed by the image forming unit onto a printing medium, wherein the transfer apparatus comprises:

a transfer belt;

a driving unit having a plurality of rollers to rotate the transfer belt; and at least one regulating unit to regulate a floating movement of the transfer belt and the driving unit in an axial direction of shafts of the rollers thus to be in an original position wherein the regulating unit comprises:

a regulating member to interfere with an axial movement in the axial direction of one of the plurality of rollers; and an elastic member in direct contact with a shaft of the one roller and disposed between the shaft of the one roller and the regulating member to apply an elastic force in a driving direction of the transfer.

2. The image forming device of claim 1, wherein the driving unit comprises a plurality of rollers to come in contact with and to rotatably support an inner side surface of the transfer belt.

3. The image forming device of claim 1, wherein the plurality of rollers comprises at least one driving roller to rotatably support one end of the transfer belt and at least one idle roller to rotatably support the other end of the transfer belt.

4. The image forming device of claim 3, wherein the regulating unit regulates a floating movement of the idle roller.

5. The image forming device of claim 4, wherein the regulating member is disposed to be rotatable between a first position coming in contact with a shaft of the idle roller positioned in position and a second position rotated by an axial movement of the idle roller.

6. The image forming device of claim 5, wherein the regulating member comprises a contacting end to come in contact with the shaft of the idle roller when the idle roller moves in the axial direction and a supporting end to move in combination with a movement of the contacting end and to support the elastic member.

7. The image forming device of claim 6, wherein the contacting end and the supporting end are in right angles to each other about a rotating shaft.

8. The image forming device of claim 5, wherein the elastic member presses a shaft of the idle roller by a rotating range of the regulating member in the rotating direction of the transfer belt.

9. The image forming device of claim 5, wherein the regulating member further comprises a rotational shaft to connect the contacting end and the supporting end, the rotational shaft being positioned on a different shaft than the shafts of the rollers.

10. A transfer apparatus usable with an image forming apparatus, comprising:

a transfer belt;

a driving unit including a plurality of rollers to rotate the transfer belt; and at least one regulating unit having a regulating member disposed to be movable according to a movement of one of the driving unit and the transfer belt in an axial direction of the rollers and an elastic member connected between the driving unit and the regulating member to regulate the movement, wherein the elastic member generates a first elastic force to the regulating member with respect to the driving unit, and a second elastic force to the driving unit to regulate the movement.

11. The transfer apparatus of claim 10, wherein:

the movement comprises a first movement in a first direction and a second movement in a second direction: and a combination of the regulating member and the elastic member regulates the first movement and the second movement.

12. The transfer apparatus of claim 10, wherein the elastic member controls the regulating member to be biased toward the driving unit.

13. The transfer apparatus of claim 10, wherein the regulating member comprises one end connected to the elastic member and another end extended from the one end toward the driving unit to move according to the second movement.

14. The transfer apparatus of claim 10, wherein:

the regulating member is rotatably disposed to move according to the second movement of the one of the transfer belt and the driving unit; and the elastic member is elastically and directly connected between a shaft of one of the rollers and the regulating member to control at least one of the first movement and the second movement.

15. The transfer apparatus of claim 10, wherein:

the at least one regulating unit comprises first and second regulating units disposed on opposite sides of the driving unit;

the regulating member comprises first and second regulating members;

the elastic member comprises first and second elastic members to form the first and second regulating units with the first and second elastic members, respectively.

16. The transfer apparatus of claim 15, wherein:

the first regulating member moves in a first direction according to the movement;

the second regulating member moves in a second direction according to the movement; and the second elastic member generates an elastic force to the one of the driving unit and the transfer belt in a third direction to regulate the movement.

17. The transfer apparatus of claim 15, further comprising:

an interfering member to restrict the movement of the second regulating member.

18. A transfer apparatus usable with an image forming apparatus, comprising:

a transfer belt;

a driving unit including a driving roller and an idle roller to rotate the transfer belt;

at least one regulating unit to regulate a floating movement of the transfer belt and the driving unit, the at least one regulating unit comprising:

a contacting end to come in contact with a shaft of the idle roller when the idle roller moves in an axial direction of the idle roller;

a rotating shaft aligned perpendicular to the shafts of the driving unit rollers;

a supporting end connected to the contacting end via the rotating shaft, the supporting end rotating about the rotating shaft as a result of the movement of the idle roller.

19. The transfer apparatus of claim 18, the at least one regulating unit further comprising an elastic member directly connected between the supporting end and the shaft of the idle roller.

20. The image forming device of claim 18, wherein the rotational shaft is positioned on a separate shaft than shafts of the rollers.

21. The transfer apparatus of claim 18, wherein the idle roller comprises a first shaft adjacent a first regulating unit on one side of the transfer belt and a second shaft adjacent a second regulating unit on a second side of the transfer belt.

22. The transfer apparatus of claim 21, wherein when the idle roller is moved in a first axial direction to contact the contacting end, the supporting end rotates about the rotating shaft to move the first shaft in a second direction and the second shaft in a third direction.

23. A transfer apparatus usable with an image forming apparatus, comprising:

a transfer belt;

a driving unit to rotate the transfer belt; and at least one regulating unit having a regulating member disposed to be movable according to a movement of the driving unit and an elastic member connected between the driving unit and the regulating member to regulate a movement of one of the transfer belt and the driving unit, wherein the elastic member generates a first elastic force to the regulating member with respect to the driving unit, and a second elastic force to the driving unit to regulate the movement.

* * * * *